US005142296A

United States Patent [19]

Lopez et al.

[11] Patent Number: 5,142,296

[45] Date of Patent: Aug. 25, 1992

[54] INK JET NOZZLE CROSSTALK SUPPRESSION

[75] Inventors: Juan E. Lopez, Newbury Park; Edgar Sheh; Joe Lahut, both of Thousand Oaks; Dung Do, Burbank, all of Calif.

[73] Assignee: Dataproducts Corporation, Woodland Hills, Calif.

[21] Appl. No.: 611,124

[22] Filed: Nov. 9, 1990

[51] Int. Cl.[5] ..... B41J 2/045

[52] U.S. Cl. ..... 346/1.1; 346/140 R; 400/126

[58] Field of Search ..... 346/1.1, 75, 140 R, 346/76 PH; 400/126

[56] References Cited

U.S. PATENT DOCUMENTS

| | | | |
|---|---|---|---|
| 4,251,823 | 2/1981 | Sagae | 346/140 R |
| 4,345,262 | 8/1982 | Shirato et al. | 346/140 R |
| 4,395,720 | 7/1983 | Grover et al. | 346/140 R |
| 4,492,968 | 1/1985 | Lee et al. | 346/140 R |
| 4,779,102 | 10/1988 | Sasaki | 346/76 PH |
| 4,873,535 | 10/1989 | Sasaki | 346/1.1 |
| 4,875,056 | 10/1989 | Ono | 346/76 PH |

FOREIGN PATENT DOCUMENTS

| | | | |
|---|---|---|---|
| 0005280 | 1/1983 | Japan | 346/76 PH |
| 0067175 | 4/1985 | Japan | 346/76 PH |
| 0064468 | 4/1986 | Japan | 346/76 PH |
| 0241169 | 10/1986 | Japan | 346/76 PH |
| 0051153 | 3/1988 | Japan | 346/76 PH |
| 0091266 | 4/1988 | Japan | 346/76 PH |

*Primary Examiner*—George H. Miller, Jr.
*Assistant Examiner*—Alrick Bobb
*Attorney, Agent, or Firm*—Spensley Horn Jubas & Lubitz

[57] ABSTRACT

In an ink jet printer having a plurality of ink jet channels which are individually controllable to produce ink dots on a printing medium, crosstalk is reduced by activating each odd numbered channel in alternation with each even numbered channel, while offsetting the orifices of one group of channels from the other to compensate for the time difference between activations, and the voltage supplied to excite the channel transducers is varied as a function of the number of channels simultaneously excited to maintain a fixed excitation voltage across each transducer.

6 Claims, 3 Drawing Sheets

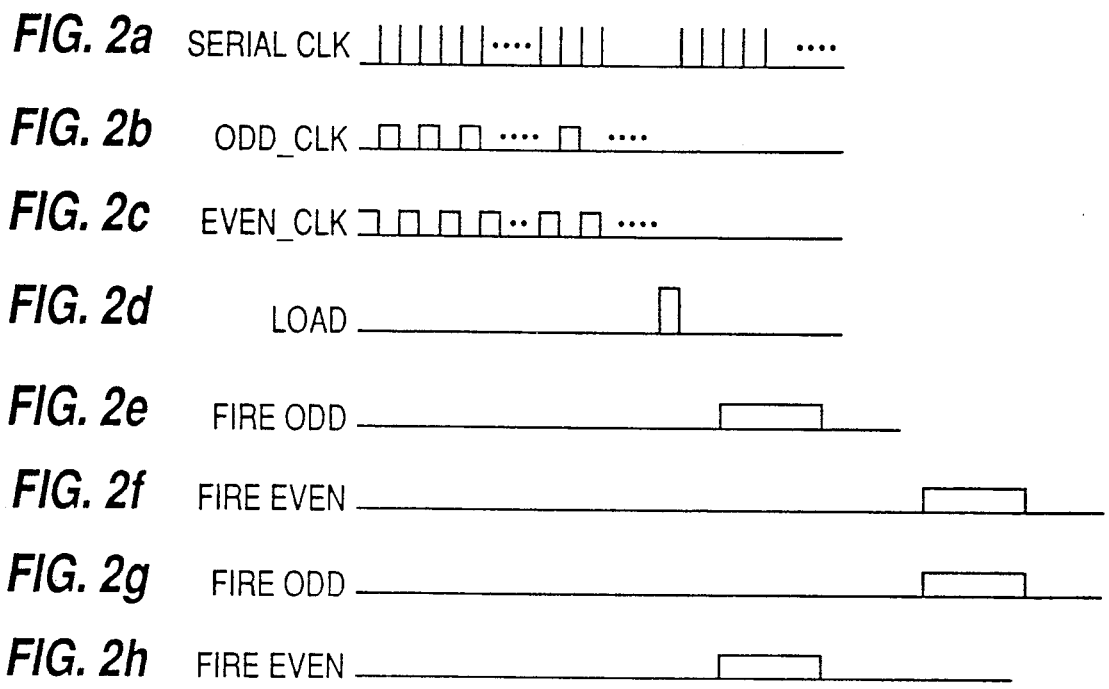
FIG. 3
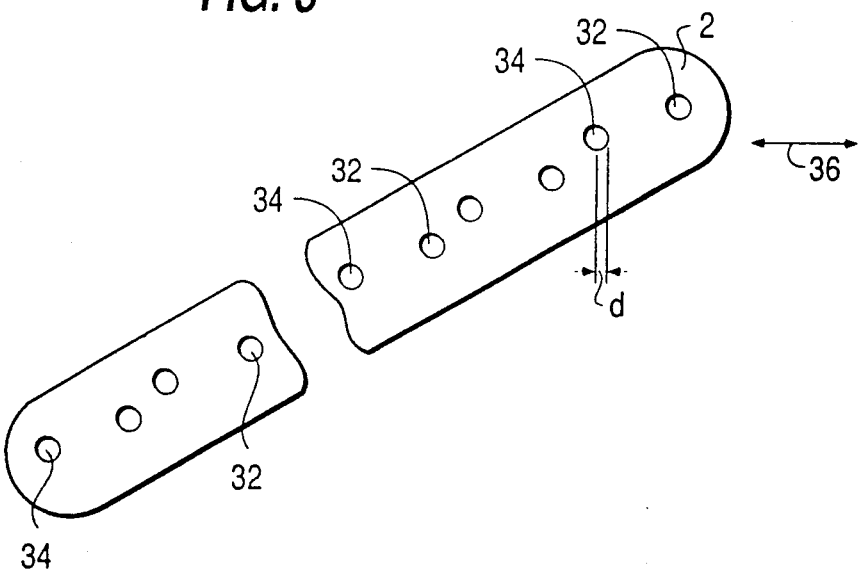

INK JET NOZZLE CROSSTALK SUPPRESSION

BACKGROUND OF THE INVENTION

Field of the Invention

The present invention relates to ink jet printers of the type having a print head carrying a plurality of individually controlled ink delivery channels, each channel having an ink drop ejection transducer and ending in a nozzle having an outlet orifice, with the orifices typically arranged in a row that extends transversely to a row printing direction.

In modern ink jet printers, high resolution is made possible by disposing the nozzle orifices very close together. This requires that the channels themselves be disposed close together and, as a result, dynamic forces, or excitations, exerted on one nozzle transducer generate lower level forces at adjacent transducers, a phenomenon known as crosstalk and representative of the level of signal interference between one transducer and neighboring transducers. This, of course, has adverse effects on the quality of the resulting image. Typically, these transducers are piezoelectric devices.

Various techniques for eliminating or minimizing crosstalk which have been proposed involve more or less complex modifications of the print head structure and notably the transducer, the fluid paths, or selected structural parameters of the print head. These solutions have either provided limited operating improvements or are costly and complex to implement. One reason that significant improvements have been elusive is that any modification of one parameter invariably influences other parameters in an unpredictable manner.

Further, in a print head of the type described above, all of the ejection transducers are connected to a single source of a driving voltage which imposes an excitation voltage across each transducer which is to be actuated, or "fired". Since all of the transducers are connected electrically in parallel with the driving voltage, the resulting excitation voltage across each connected transducer tends to decrease as the number of transducers fired at a given time increases. A decrease in this voltage results in a corresponding decrease in the velocity with which each ink drop is ejected and the size of the dot formed by each ink jet droplet. This represents another type of crosstalk which adversely affects print quality.

SUMMARY OF THE INVENTION

It is a primary object of the present invention to reduce or eliminate the types of crosstalk described above in a simple and economical manner.

A more specific object of the invention is to increase the effective spacing between orifices which can influence one another without reducing the image resolution capabilities of the print head.

A still further object of the invention is to reduce adverse influences on print quality due to changes in the number of transducers excited from one printing step to another.

The above and other objects are achieved, according to the present invention, by a method of, and apparatus for, operating an ink jet printer having a print head provided with a plurality of individually controllable ink jet channels terminating in outlet orifices disposed adjacent one another to each eject successive ink drops on demand, the channels being arranged in two groups such that the orifices of one group alternate with the orifices of the other group, by displacing the print head in a row printing direction while controlling the channels to effect printing at successive printing locations in the row printing direction; and, for each printing location, ejecting ink from selected channels of one group in time alternation with the channels of the other group.

Objects according to the invention are further achieved by constructing a print head provided with a plurality of individually controllable ink delivery channels, each channel terminating in an ink drop ejection nozzle having an outlet orifice, the print head being arranged for movement in a printing direction parallel to a printing substrate, so that the channels are arranged in two groups with the outlet orifices of one group alternating with the outlet orifices of the other group in a direction perpendicular to the printing direction; the orifices of one group lie on a line; and each orifice of the other group is offset from the line in the printing direction.

Objects according to the invention are additionally achieved, in an ink jet printer including a print head provided with a plurality of ink jet channels, each channel including an electrically actuated transducer which acts to project a drop of ink in response to an excitation voltage, each transducer being constructed such that the velocity of each ink drop and the quantity of ink in each drop varies directly with the average value of the excitation voltage, the printer further including a control circuit and voltage source for applying an excitation voltage simultaneously to a selected number of transducers, in a manner such that the average value of the excitation voltage applied to each transducer varies inversely with the number of transducers that are simultaneously excited, by the provision of excitation voltage adjustment means connected to the voltage source for reducing variations in the excitation voltage applied to each transducer due to changes in the number of transducers which are simultaneously excited.

BRIEF DESCRIPTION OF THE DRAWINGS

FIGS. 2*a*–2*h* are timing diagrams illustrating the operation of the circuit of FIG. 1.

FIG. 3 is a pictorial view of a nozzle plate according to the invention.

DESCRIPTION OF THE PREFERRED EMBODIMENTS

Figure 1:
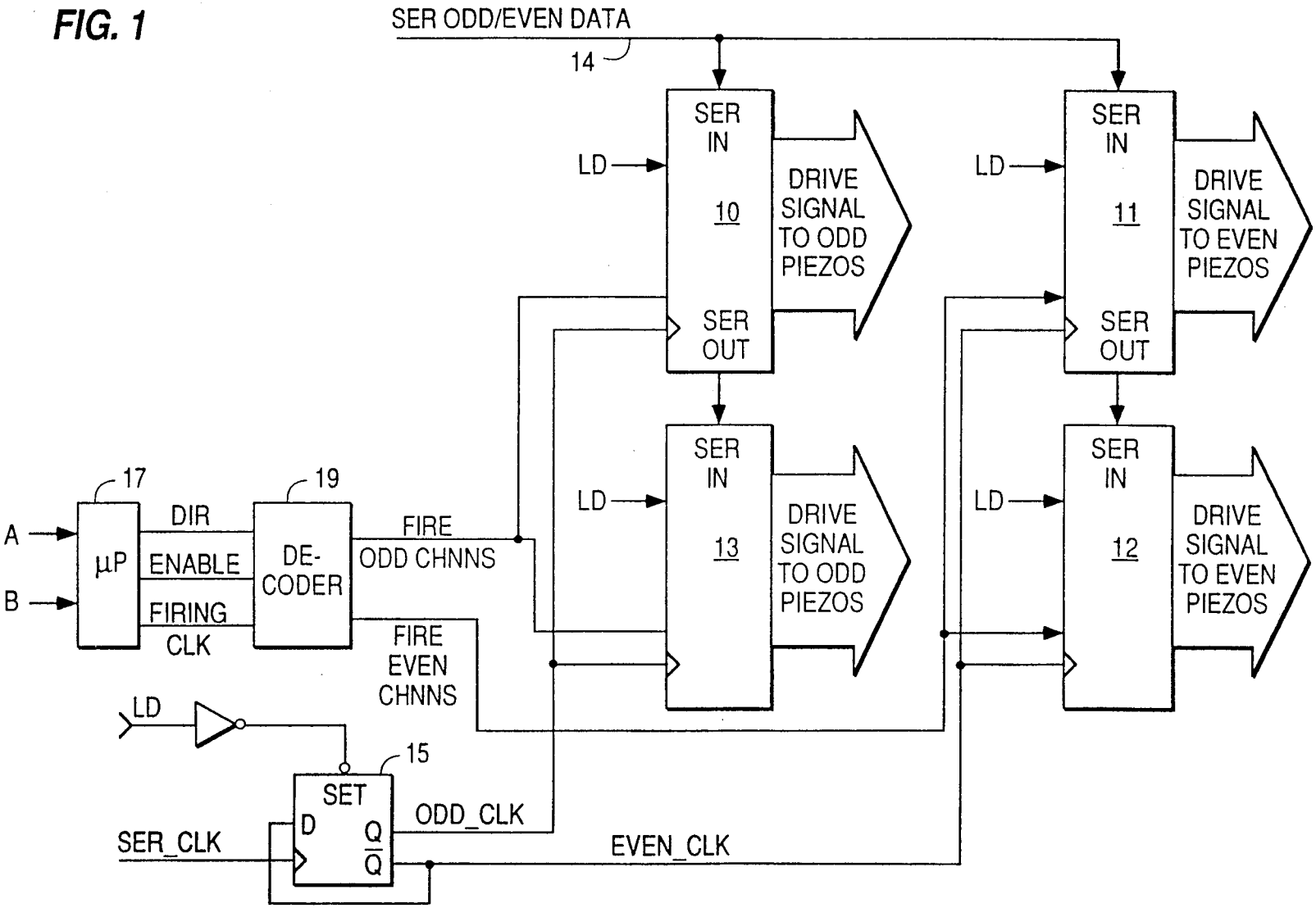
FIG. 1 is a diagram of a preferred embodiment of a print head nozzle control unit according to the invention.

FIG. 1 shows a unit according to one preferred embodiment of the invention for driving the transducers, typically piezoelectric elements, of a plurality of ink jet channels each having a nozzle ending in a respective outlet orifice. To implement the invention, the channels are divided into a first set composed of odd numbered channels and a second set composed of even numbered channels arranged so that the outlet orifices of the odd numbered channels alternate with those of the even numbered channels.

All of the transducers are driven by drive circuits 10–13, each of which is composed of a shift register stage and switches for supplying an excitation voltage to selected transducers. Drive circuits 10–13 themselves can be constructed according to principles well known in the art.

However, according to the invention, each circuit 10–13 is assigned to a respective group of odd numbered or even numbered channels. In the illustrated embodiment, drive circuits 10 and 13 are each assigned to a respective group of odd numbered channels and drive circuits 11 and 12 are each assigned to a respective group of even-numbered channels. Circuits 10–13 are controlled in a time pattern such that, for printing at each printing location, the odd-numbered channels are excited, or driven, via circuits 10 and 13 at a different moment from excitation of even-numbered channels via circuits 11 and 12.

The distribution of data between the odd-numbered and even-numbered channels is controlled by odd clock and even clock read control signals supplied, respectively, to circuits 10 and 13 and circuits 11 and 12. As shown, the shift registers of each pairs of circuits are connected in series. After a complete set of data bits, for controlling all ink channels, have been transferred to circuits 10–13, a load signal, LD, is issued to transfer these bits to switches for controlling the application of drive voltage to those transducers which are to fired. Subsequently, the odd-numbered channels and the even-numbered channels are fired in sequence in an order which depends upon the direction of movement of the print head, i.e. left-to-right or right-to-left.

The odd clock and even clock read control signals are generated by supplying a basic serial clock signal, which also controls the rate of delivery of data signals on line 14, to the clock input of a D flip-flop 15 whose inverted output is connected to its D input so that each serial clock signal supplied to flip-flop 15 reverses the signal state at each output Q and $\overline{Q}$. Thus, each of these clock signals has a rate equal to one-half that of the conventional serial clock signal and the odd clock signal pulses occur in phase opposition to the even clock signal pulses.

The signals to fire the odd numbered and even numbered channels are produced on the basis of conventional encoder signals A and B produced in response to movement of the print head. Encoder signals A and B are square wave signals which are shifted in phase from one another by 90°, with the direction of the phase difference being dependent on the direction of movement of the print head. These encoder signals can be a source of a clock signal composed of a series of pulses, with each pulse corresponding to a respective printing position of the print head.

Signals A and B are applied to a microprocessor 17 programmed to produce a direction signal, a one-bit signal representing the current direction of movement of the print head, an enable signal, also a one-bit signal indicating that the odd numbered and even numbered channels should be fired in alternation, and a firing clock signal which for the practice of the present invention has a pulse rate twice that of the above-mentioned clock signal derived from encoder signals A and B.

The signals produced by microprocessor 17 are supplied to a decoder 19 which produces the odd and even channel firing signals. Decoder 19 can be constructed on the basis of principles well known in the art.

The time difference between firing of the odd numbered channels and the even numbered channels is selected to allow the disturbances associated with one set of channels to die down prior to excitation of the other set of channels. Preferably the time difference is equal to one-half the period of travel of the print head between successive printing locations. In other words, excitation will alternate at uniform intervals between the odd-numbered channels and the even-numbered channels and the sum of the firing rates for both sets of channels is twice that in a conventional printer.

The relation among the signals employed to control the above described operation is depicted FIGS. 2*a*–2*h*. *FIG. 2a* illustrates the conventional serial clock, and FIGS. 2*b* and 2*c* show the odd and even read clocks derived from the clock of FIG. 2*a*. The load pulse LD applied to flip-flop 15 and to circuits 10–13 is shown in FIG. 2*d*. FIGS. 2*e* and 2*f* show one sequence of odd and even firing pulses when the print head is moving in one direction, while FIGS. 2*g* and 2*h* show the sequence when the print head is moving in the opposite direction.

If, despite the time difference introduced between the two channel groups, it is desired that the ink dots supplied by all channels be located on vertical rows perpendicular to the row printing direction, the channels are arranged so that the orifices of one set are displaced by an appropriate amount in the row printing direction.

Thus, as shown in FIG. 3, a nozzle, or orifice, plate 30 for use in a print head according to the present invention is provided with orifices 32 associated with the odd numbered channels and orifices 34 associated with the even numbered channels. Orifices 32 lie on a first straight line and orifices 34 lie on a second straight line which is laterally offset from the first straight line by a distance such that each orifice 34 is shifted from its normal position by a distance, d, in the row printing direction 36. In the direction perpendicular to row printing direction 36, all orifices 32, 34 are equispaced.

If the time difference between excitation of the two groups is, as described above, equal to one-half the period of travel of the print head between successive printing locations, then d equals one-half the distance travelled by head 2 between printing locations. Thus, if the latter distance is equal to the diameter of each ink dot, d equals one-half of the dot diameter.

According to a further feature of the invention, which can be used in conjunction with the time shifted excitation technique described above, the magnitude of the excitation voltage for the channel transducers is varied as a function of the number of transducers to be actuated, or fired, in order to prevent or minimize variations in channel performance, and specifically variations in ink jet velocity and ink dot size.

The ink jet channels presently utilized in print heads employ piezoelectric transducers which are contracted by an excitation voltage and then, upon removal of the excitation voltage, produce an impulse which ejects an ink droplet. The extent of contraction, which is dependent on the magnitude of the excitation voltage, determines both the ejection velocity and resulting ink dot size.

Such excitation voltage is obtained by connecting each transducer to a drive voltage source. The magnitude of the excitation voltage at each transducer is dependent, in the first instance, on the magnitude of the drive voltage. However, for a given drive voltage value, the excitation voltage across any one transducer decreases as the number of transducers being excited increases.

Applicants have determined that this excitation voltage variation can be compensated by a corresponding increase in the drive voltage.

Figure 4:
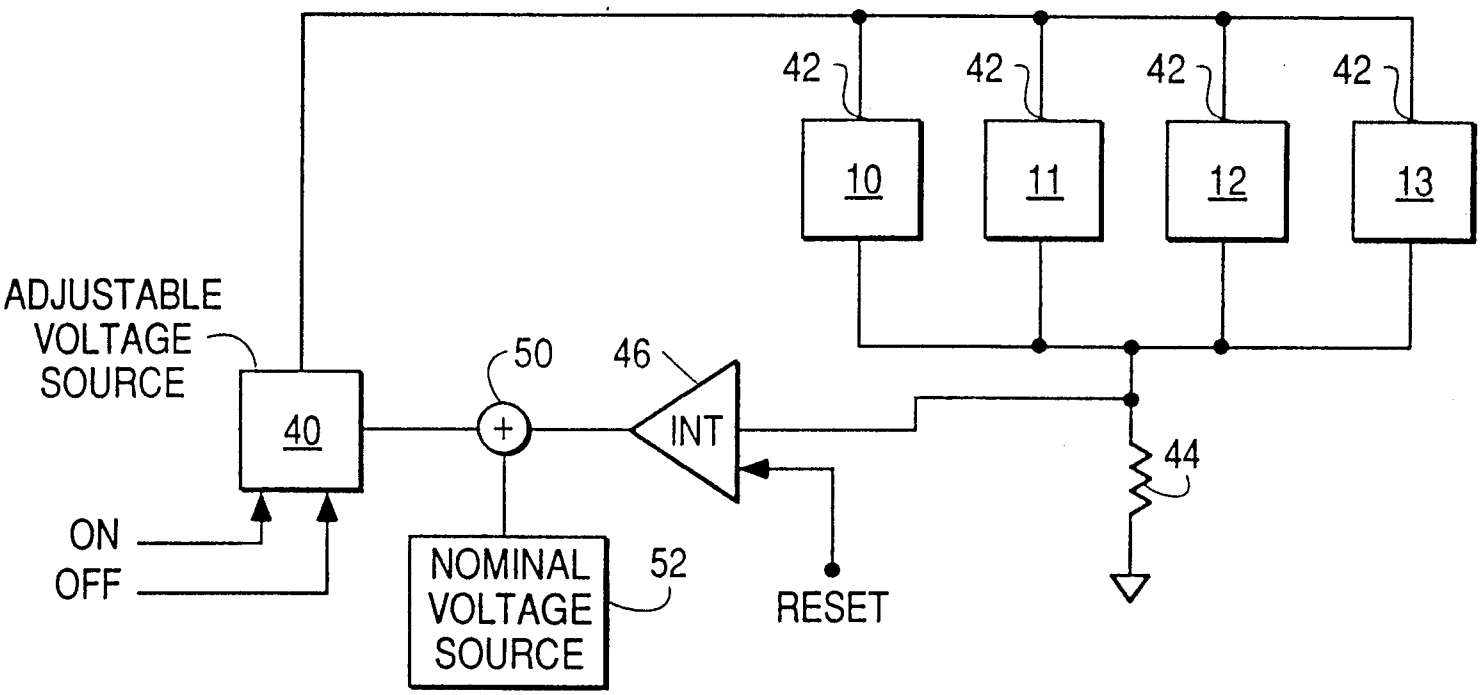
FIG. 4 is a circuit diagram of an additional control unit according to the invention.

FIG. 4 illustrates one suitable embodiment for achieving such compensation according to the present invention. The transducer drive voltage is provided by an adjustable voltage source 40 connected to the high voltage inputs 42 of four drive circuits 10–13. The drive voltage path in each drive circuit is completed by a return path connected to ground via a common sense resistor 44. For a given drive voltage, the total current through the drive voltage paths and through resistor 44 increases in proportion to the number of transducers being excited.

The voltage appearing across resistor 44 is supplied to the signal input of an integrator 46 connected, in turn, to one input of a summing circuit 50. Summing circuit 50 has a second input connected to receive a settable control voltage component from a nominal control voltage source 52. The sum of the output voltages from integrator 46 and from source 52 are supplied to the control input of source 40 to control the magnitude of the drive voltage produced by source 40.

During each printing cycle, integrator 46 is turned on during application of the drive voltage to those transducers which are to produce an ink jet. Preferably, integrator 46 is turned on simultaneously with the start of drive voltage application to the transducers and is turned off when the drive voltage is terminated. Thus, the output voltage from integrator 46 will be proportional to the number of transducers being excited during the printing cycle. This output voltage then acts to increase the drive voltage from source 40 by the desired amount.

Before the next printing cycle, integrator 46 is reset to a zero output level to prevent any residual influence on the compensation produced during the next print cycle. Preferably, resetting is effected by the signal which turns off source 40.

To cite one specific example of the implementation of the invention, in a print head containing 96 channels with 24 channels being controlled by each of circuits 10—and 48 channels being capable of being fired simultaneously, the change in the drive voltage needed to achieve the desired compensation varies essentially linearly with the number of channels to actually be fired up to a maximum of about 20% of the nominal value. The nominal value corresponds to the desired value when one channel is to be fired and the maximum value is the desired value when all 48 channels are to be fired simultaneously.

The gain of integrator 46 is selected to establish the desired relation between the current through resistor 44 and the desired drive voltage value.

When the unit shown in FIG. 4 is combined with the unit shown in FIG. 1, the channels controlled by circuits 10 and 13 are excited in time alternation with the channels controlled by circuits 11 and 12, source 40 is turned on by the leading edge of each firing pulse (FIGS. *2e–2h*), and source 40 is turned off and integrator 46 reset by the trailing edge of each firing pulse. In this case, integrator 46 is reset after excitation is terminated for each pair of circuits. Otherwise, the unit of FIG. 4 will operate in the manner described above.

Control of the drive voltage can be achieved in other ways within the spirit of the invention. For example, in place of current sensing, the voltage across each transducer can be monitored and the number of transducers being excited can be used as a basis for adjusting the drive voltage. According to another alternative, the serial data supplied to the drive circuits, or each pair of drive circuits when the unit of FIG. 1 is employed, is monitored and the number of bits associated with the simultaneous firing of the odd numbered and even numbered channels is counted. The resulting count value is then used to adjust the drive voltage.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method of operating an ink jet printer having a print head provided with a plurality of individually controllable ink jet channels terminating in orifices disposed adjacent one another to each eject successive ink drops on demand, the channels being arranged in two groups such that the orifices of one group alternate with the orifices of the other group, each channel including a piezoelectric transducer which acts to project a drop of ink in response to an excitation voltage, the transducers being constructed such that an increase in the number of transducers which simultaneously produce a drop of ink is accompanied by a decrease in the velocity of each ink drop and a decrease in the quantity of ink in each drop, said method comprising the steps of: displacing the print head in a row printing direction while controlling the channels to effect printing at successive printing location in the row printing direction; for each printing location, controlling selected channels of one group in time alternation with the channels of the other group; and varying the excitation voltage applied to the transducers of each group in a manner to increase the excitation voltage as the number of transducers which simultaneously project a drop of ink increases; said steps of controlling and varying being performed during the course of said displacing step.

2. A method as defined in claim 1 wherein each group of channels lies on a respective line and the lines are spaced from one another, in the row printing direction, by an amount corresponding to the difference in time between operation of the two groups of channels.

3. A method as defined in claim 2 wherein the spacing between lines is equal to one-half the distance between successive printing locations, and the difference in time is equal to one-half the travel time of the print head between successive printing locations.

4. In an ink jet printer having a print head provided with a plurality of individually controllable ink jet channels terminating in outlet orifices disposed adjacent one another to each eject successive ink drops on demand, the channels being arranged in two groups such that the orifices of one group alternate with the orifices of the other group, each channel including a piezoelectric transducer which acts to project a drop of ink in response to an excitation voltage, the transducers being constructed such that an increase in the number of transducers which simultaneously produce a drop of ink is accompanied by a decrease in the velocity of each ink drop and a decrease in the quantity of ink in each drop, the printer further including means for displacing the print head in a row printing direction while controlling the channels to effect printing at successive printing location in the row printing direction, the improvement comprising means for controlling said channels so that, at each printing location, selected channels of one group are operated to eject ink drops in time alternation with the channels of the other group, and means for varying the excitation voltage applied to the transducers of each group in a manner to increase the excitation voltage as the number of transducers which simultaneously project a drop of ink increases.

5. A printer as defined in claim 4 wherein: said print head is provided with a plurality of individually controllable ink delivery channels, each channel terminating in an ink drop ejection nozzle having an outlet orifice; said outlet orifices of one group alternate with said outlet orifices of the other group in a direction perpendicular to the printing direction; said orifices of said one group lie on a line; and each said orifice of said other group is offset from the line in the printing direction.

6. In an ink jet printer including a print head provided with a plurality of ink jet channels, each channel including a piezoelectric transducer which acts to project a drop of ink in response to an excitation voltage, the transducers being constructed such that an increase in the number of transducers which simultaneously produce a drop of ink is accompanied by a decrease in the velocity of each ink drop and a decrease in the quantity of ink in each drop, the printer further including a control circuit and voltage source for applying an excitation voltage simultaneously to a selected number of transducers, the improvement comprising means connected for varying the excitation voltage produced by said source in a manner to increase the excitation voltage as the selected number of transducers to which the excitation voltage is simultaneously applied increases.

* * * * *